US006748840B2

(12) United States Patent
Harfst

(10) Patent No.: US 6,748,840 B2
(45) Date of Patent: Jun. 15, 2004

(54) SAW CHAIN HAVING DRIVE LINK WITH GUARD FEATURE

(75) Inventor: Michael D. Harfst, Milwaukie, OR (US)

(73) Assignee: Blount, Inc., Portland, OR (US)

( * ) Notice: Subject to any disclaimer, the term of this patent is extended or adjusted under 35 U.S.C. 154(b) by 0 days.

(21) Appl. No.: 10/214,986

(22) Filed: Aug. 7, 2002

(65) Prior Publication Data

US 2004/0025355 A1 Feb. 12, 2004

(51) Int. Cl.[7] ..... B27B 33/14
(52) U.S. Cl. ..... 83/830; 83/834
(58) Field of Search ..... 83/830, 831, 832, 83/833, 834

(56) References Cited

U.S. PATENT DOCUMENTS

| | | | | | |
|---|---|---|---|---|---|
| 1,150,218 | A | * | 8/1915 | Martin | 83/833 |
| 3,180,378 | A | | 4/1965 | Carlton | |
| 3,444,907 | A | * | 5/1969 | Chadwick | 83/831 |
| 4,348,927 | A | * | 9/1982 | Olmr | 83/833 |
| 4,353,277 | A | | 10/1982 | Silvon | |
| 4,425,830 | A | | 1/1984 | Atkinson | |
| 4,459,890 | A | | 7/1984 | Dolata et al. | |
| 4,558,621 | A | | 12/1985 | Nitschmann et al. | |
| 4,581,968 | A | * | 4/1986 | Gibson et al. | 83/833 |
| 4,604,932 | A | | 8/1986 | Doiron | |
| 4,625,610 | A | * | 12/1986 | Petrovich | 83/834 |
| 4,627,322 | A | * | 12/1986 | Hayhurst, Jr. | 83/831 |
| 4,756,221 | A | | 7/1988 | Nitschmann et al. | |
| 5,257,568 | A | | 11/1993 | Nitschmann | |
| 6,308,606 | B1 | * | 10/2001 | Buchholtz et al. | 83/834 |

FOREIGN PATENT DOCUMENTS

| | | |
|---|---|---|
| CA | 721087 | * 11/1965 |
| DE | 1 040 796 | * 10/1958 |
| GB | 2 067 465 | * 7/1981 |

* cited by examiner

*Primary Examiner*—Allan N. Shoap
*Assistant Examiner*—Jason Prone
(74) *Attorney, Agent, or Firm*—Schwabe, Williamson & Wyatt, P.C.

(57) ABSTRACT

A saw chain for a chain saw including alternating center and side link pairs with certain of said side links being cutting links and certain of said center links preceding said cutting links having guard portions to inhibit kick back. Said guard portions including a forward and rearward guard portion, the rearward guard portion in overlapping relation with a depth guide of the cutting link. A relief spacing between the guard portions facilitates chip carriage and the guard portions cooperatively form a ramp to guide wood being cut over and onto the depth gauge for controlling the depth of cut taken by the cutting link.

3 Claims, 2 Drawing Sheets

SAW CHAIN HAVING DRIVE LINK WITH GUARD FEATURE

FIELD OF THE INVENTION

This invention relates to a saw chain for cutting wood, e.g. trees and logs, which saw chain includes a guard feature that inhibits the occurrence of kickback, and more particularly wherein the guard feature is provided on the center links of the saw chain preceding the saw chain cutters or cutting links.

BACKGROUND OF THE INVENTION

A popular saw chain used on consumer-type chain saws is a ⅜" pitch chain having a low profile and provided with side links having a guard feature. The guard feature is provided above the body portion of certain of the side links and extends substantially the length of the body portion and somewhat rearwardly of the body portion. Thus, a following side link cutter is substantially protected from taking an excessive bite or penetration into the wood, particularly when there is contact between the chain at the upper quadrant of the bar nose and the material being cut (when cutting with the nose) or accidental contact with nearby branch or the like. Such contact may induce kickback.

Although popular, this chain is perceived to cut less efficiently due to the presence of the guard feature and, from the manufacturer's point of view, is more costly to produce than is desired.

BRIEF DESCRIPTION OF THE INVENTION

A cost issue results from the significant number of parts that have to be produced and assembled for the prior chain. The parts include: 1. a left-hand cutter; 2. a right-hand cutter; 3. a standard center drive link; 4. a standard tie strap (that fits on either side of the chain); 5. a right-hand guard side link; and 6. a left-hand guard side link. It is desirable to provide a center drive link with a guard portion rather than a side link in that this reduces the number of parts from six to five (the center guard link replacing both left and right-hand side guard links).

Cutting speed is believed to be affected by the length and height of the guard portion, in that the gaps between the cutting teeth of the cutting links carry the chips that have been cut and when this space fills up (partially due to the presence of the guard portion), the cutting teeth are forced away from the kerf bottom, i.e. out of the cutting mode. However, it is known that a reduced, e.g., shortened guard portion for the side link (front to back) is not as effective in preventing kickback. Particularly during a nose cut, the depth gauge of the cutting link as well as a shortened guard portion will be pressed into the kerf bottom, thereby compressing the wood which allows the following cutting tooth to penetrate further into the kerf and take the undesired excessive bite that can cause kickback. The longer guard portion requires a greater pressure to compress the wood and, thus, more effectively guards against the undesired excessive bite problem.

The present invention provides a guard portion at least at the trailing portion of the center link and because the cutting link and center link are overlapped (they share a common pivotal connection), the upwardly extended trailing guard portion is positioned alongside the depth gauge of the cutting link. This double thickness of depth gauge and guard portion is believed to more effectively resist penetration into the wood fibers of the kerf bottom (as compared to an elongated single thickness) and substantially enhances the resistance to excessive penetration of the following cutting tooth. In the preferred embodiment, the guard portion is relieved in the center area forward of the trailing guard portion to provide added chip carrying capacity, and then the center link is provided with a leading guard portion formed to provide a ramping effect that assists in resisting cutting tooth penetration but without unduly restricting chip-carrying capacity.

In the preferred embodiment, the configuration of the leading and trailing portions of the center link are cooperatively formed so that the ramp of the leading portion ramps the wood being cut in a direction that projects above the leading edge of the trailing portion, the leading edge of the trailing portion being itself shaped to avoid presenting a corner that might dig into the kerf.

The invention will be more fully appreciated upon reference to the following detailed description of the preferred embodiment having reference to the accompanying drawings. The cutting chain therein described has been found to be a lower-cost chain construction while providing improved cutting performance and without sacrificing safety.

A prior art patent that discloses a guard portion overlapping with the depth gauge is U.S. Pat. No. 4,425,830. However, the overlapping guard portion is provided on a preceding side link, the overlying guard portion extended rearwardly of the rear rivet of the side link which precedes the forward rivet of the cutting link. As will be noted from FIG. 3 thereof, the rearwardly extended guard portion pivots upwardly as the chain traverses the nose of the chain saw. Such upward pivoting inhibits the ability of the cutter to achieve a desired cutting penetration during nose cutting.

DETAILED DESCRIPTION OF THE PREFERRED EMBODIMENT

Figure 1:
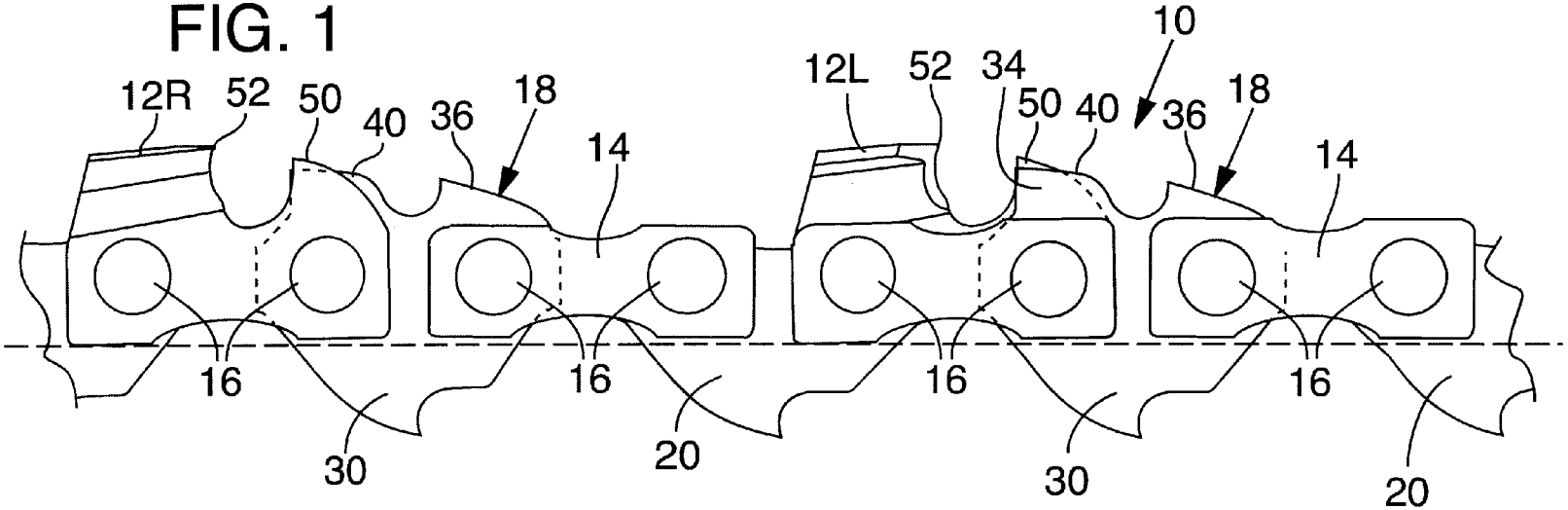
FIG. 1 is a side view of a sequence of links provided for a saw chain of the present invention.
Figure 2:
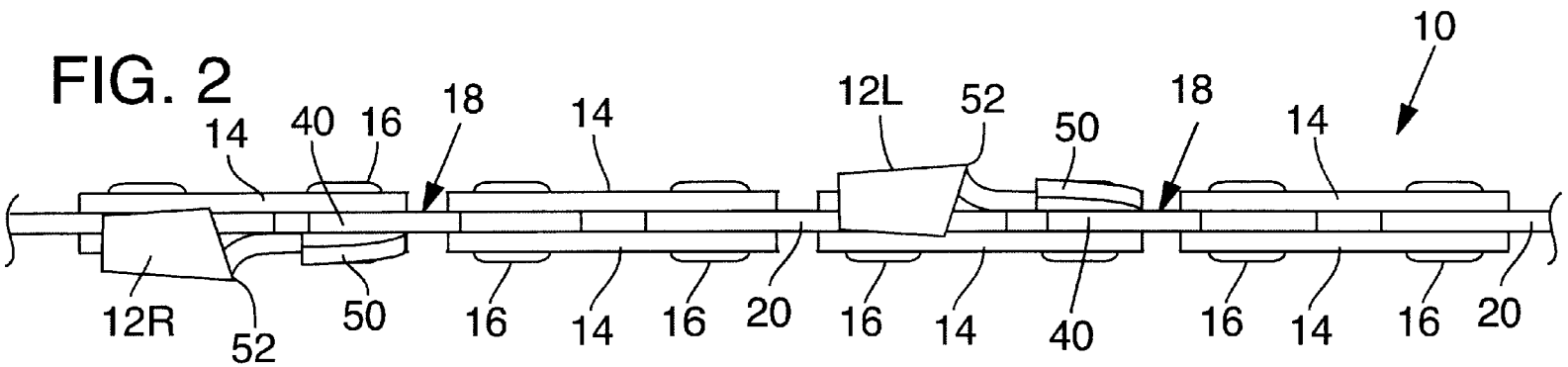
FIG. 2 is a top view of the sequence of links illustrated in FIG. 1.

Reference is made to FIGS. 1 and 2 which illustrates a section of saw chain 10 of a preferred embodiment of the invention. The saw chain 10 includes a left-hand cutting link 12L and an opposing tie strap or side link 14 pivotally connected at the forward end by a rivet 16 to a rearward end of a guard bearing center link 18. The front end of the guard or guard bearing center link 18 is pivotally connected to the rear ends of a pair of opposing side links 14, which in turn are connected at their front ends to the rear end of a conventional center link 20. The front end of the center link 20 is connected to a right-hand cutting side link 12R and opposing tie strap or side link 14. A guard center link 18 precedes the cutting side link 12R, the cutting side link 12R having an opposing standard side link 14, which are then preceded by a standard center link 20. The sequence is then repeated. All connections are pivotal connections provided by rivets 16. The reader will however appreciate that the above sequence of links can and is modified and that the invention is not limited by any specific sequence.

Figure 3:
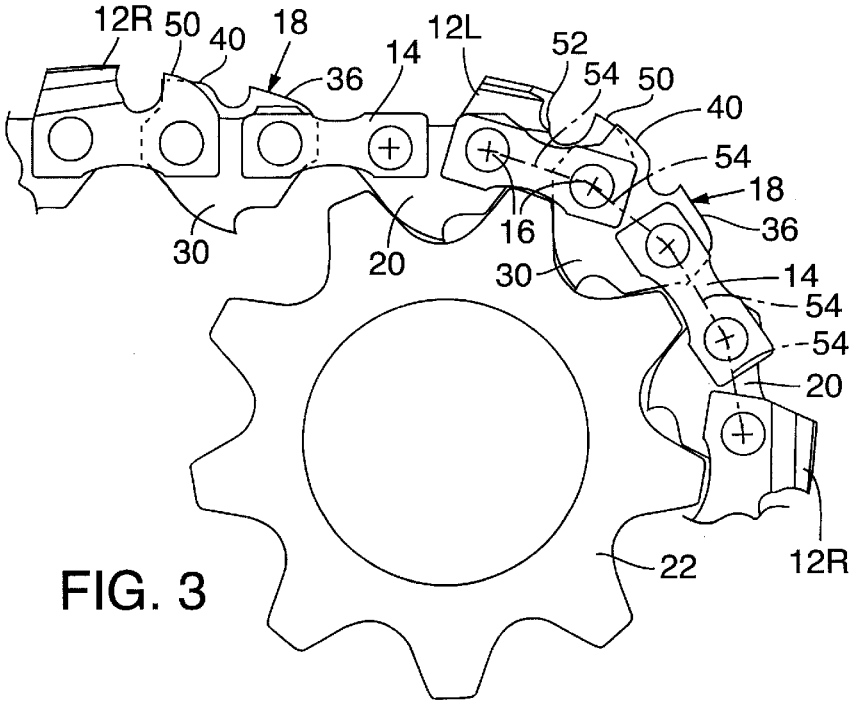
FIG. 3 is an illustration of a sequence of links in accordance with the invention mounted on a nose sprocket as when rounding the nose of a chain saw guide bar.
Figure 4:
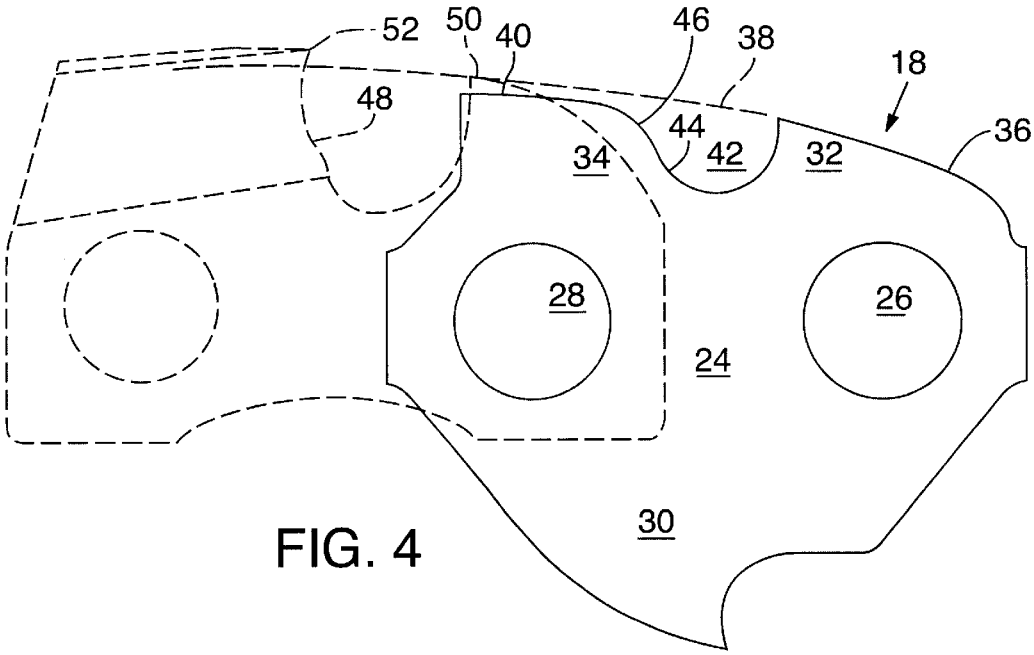
FIG. 4 is a side view of the center link only of the saw chain of FIG. 1, but showing a cutting link in phantom.

The present invention encompasses the guard-bearing center link 18 and its relation to the succeeding cutting link 12L/12R, which is illustrated in FIGS. 1 and 2 when travelling on a straight reach of the saw bar, and in FIG. 3 when travelling around the nose end of the bar and supported on a nose sprocket 22. Before describing the above relationship, the configuration of the guard or guard-bearing center link 18 will be described by way of example with reference to FIG. 4. As shown in FIG. 4, the chassis or body portion 24 encompasses front and rear rivet holes 26, 28 respectively. Extended below the chassis 24 is a drive tang 30, which is adapted to slide in a groove formed in a guide bar of a chain saw. It also seats in the gullets of the nose sprocket when traversing the nose of the bar as seen in FIG. 3 and engages the drive sprocket at the opposite end for driving the chain (not shown but well known to those skilled in the art). Projected above the chassis 24 is a front upwardly extended portion 32 and a rear upwardly extended portion 34. In FIG. 1, the guard portions 32 and 34 of the center link 18 preceding cutting link 12L can be observed to extend above the side links 14 which correspond in height to the chassis or body portion 24 of the center link 18.

Again by way of example and not intended as a specific limitation of the invention, the front portion 32 provides an inclined upper edge 36 that is slightly curved as it extends rearwardly. An imaginary rearward extension of edge 36 is illustrated by dash line 38. As shown, an upper edge 40 of the rear portion 34 is also slightly inclined front to rear and is substantially parallel to and below dash line 38. Intermediate the edges 36, 40 is a relief 42 that defines a bottom edge 44 that transcends from a concave semicircle to a smooth convex curve 46 that merges with edge 40. As will be noted from the dash line overlay 48 representing a following cutter link 12L/12R, the rear portion 34 of the center guard link 18 substantially overlays depth gauge 50 of cutting link 12L/12R, both of which are positioned over a common pivot, i.e., a pivot 16 extended through rivet hole 28 as illustrated in FIG. 3.

The above overlapping relationship of the guard center link 18 and cutting link 12 can be further viewed in FIGS. 1 and 2. The side-by-side relation of the overlapping portions (depth gauge 50 and rear portion 34 having upper edge 40) is illustrated in FIG. 2 as well as the relationship of these components to the common rivet 16.

Reference is now made to FIG. 3 wherein the saw chain components as described above are shown in the position where the components are rounding the nose of the guide bar and supported on nose sprocket 22. It will be observed that the chain links (12L/12R, 14, 18, 20) pivot relative to each other (note center lines 54 connecting the centers of rivets 16). Because the depth gauge 50 and guard portion 34 (identified in FIG. 3 by the upper edge 40) are controlled pivotally by the same rivet 16, the relative pivoting of depth gauge 50 and rear portion 34 is minimal. The three edges 36, 40 and upper edge of depth gauge 50 cooperatively function to guide the wood into the cutting edge 52 of the cutting tooth 12L/12R and effectively inhibits the likelihood of the cutting tooth taking an excessive bite into the wood being cut. Such is accomplished without undue interference with chip flow (see FIG. 1) and thus both safety and cutting performance are achieved.

The above preferred embodiment is but an example of the present invention and is subject to numerous variations and modifications without departing form the true and intended scope of the invention, which is defined by the claims appended hereto.

The invention claimed is:

1. A saw chain for a chain saw comprising:

a sequence of pivotally connected links including alternating side link pain and center links each having a chassis portion including a forward and rearward connecting pivot and each forward pivot of the side link pairs and rearward pivot of the center links being a common pivot as is the rearward pivot of the side link pairs and forward pivot of the center links, certain of said side link pairs including a cutting link having a cutting portion extended above the chassis and an opposed tie strap, and certain of said center links preceding said certain of said side link pairs provided with a protective guard feature;

said guard feature including a forward guard portion and a rearward guard portion projected above the chassis of said certain of said center links and above the respective forward and rearward pivots of the center link and cooperatively configured to provide a relief spacing between the forward and rearward guard portions;

said cutting links provided with a depth gauge portion projected above the chassis at the front pivot of the cutting links and having side-by-side overlapping relation with the rearward guard portion of the center links.

2. A saw chain as defined in claim 1 wherein an upper edge of the depth gauge and each of the guard portions are cooperatively sloped to provide cooperative ramping engagement of a wood member during a chain saw cutting operation.

3. A saw chain as defined in claim 2 wherein the upper edge of the forward guard portion defines a slope adjacent the relief spacing which projects rearwardly along an imaginary line that is spaced above the upper edge of the rearward guard portion.

* * * * *

UNITED STATES PATENT AND TRADEMARK OFFICE

CERTIFICATE OF CORRECTION

PATENT NO. : 6,748,840 B2
DATED : June 15, 2004
INVENTOR(S) : Harfst

It is certified that error appears in the above-identified patent and that said Letters Patent is hereby corrected as shown below:

Column 4,
Line 21, "side link pain" should read -- side link pairs --.
Line 32, "portion projected above" should read -- portion, said forward guard portion and said rearward guard having a leading edge that is sloped, and said forward guard portion and said rearward guard portion projected above --.

Signed and Sealed this

Twenty-second Day of March, 2005

JON W. DUDAS
*Director of the United States Patent and Trademark Office*